US012680292B2

(12) United States Patent
Oksanen

(10) Patent No.: US 12,680,292 B2
(45) Date of Patent: Jul. 14, 2026

(54) PREFABRICATED CABIN, METHOD FOR BUILDING CABIN AND SUPPORT LEG OF CABIN

(71) Applicant: Hetki Finland Oy Ltd, Vantaa (FI)

(72) Inventor: Janne Oksanen, Vantaa (FI)

(73) Assignee: HETKI FINLAND OY LTD, Rantasalmi AS (FI)

( * ) Notice: Subject to any disclaimer, the term of this patent is extended or adjusted under 35 U.S.C. 154(b) by 329 days.

(21) Appl. No.: 18/378,831

(22) Filed: Oct. 11, 2023

(65) Prior Publication Data

US 2024/0125110 A1 Apr. 18, 2024

(30) Foreign Application Priority Data

Oct. 12, 2022 (EP) ..... 22201120

(51) Int. Cl.

| | |
|---|---|
| ***E04B 1/34*** | (2006.01) |
| ***E04B 1/343*** | (2006.01) |
| ***E04B 2/70*** | (2006.01) |
| *E04B 1/10* | (2006.01) |
| *E04H 1/12* | (2006.01) |

(52) U.S. Cl.

CPC ..... *E04B 1/34347* (2013.01); *E04B 2/702* (2013.01); *E04B 1/10* (2013.01); *E04H 1/12* (2013.01)

(58) Field of Classification Search

CPC .... E04B 1/34347; E04B 1/34838; E04B 1/10; E04B 2/702; E04H 1/12

See application file for complete search history.

(56) References Cited

U.S. PATENT DOCUMENTS

| | | | | | |
|---|---|---|---|---|---|
| 1,875,576 | A * | 9/1932 | Een | E04B 2/702 | 52/287.1 |
| 4,003,167 | A * | 1/1977 | Saunders | E04B 1/10 | 52/262 |
| 4,777,773 | A * | 10/1988 | Fry | E04B 1/34326 | 52/220.2 |
| 2003/0182891 | A1* | 10/2003 | Reichartz | E04B 1/34838 | 52/831 |
| 2020/0299962 | A1* | 9/2020 | Espinosa | E04C 2/14 | |

FOREIGN PATENT DOCUMENTS

| | | | | |
|---|---|---|---|---|
| CH | 99913 A * | 7/1923 | ..... | E04B 2/702 |
| JP | H08013611 A | 1/1996 | | |
| WO | 2008027234 A2 | 3/2008 | | |

OTHER PUBLICATIONS

Extended Search Report with English translation mailed on Mar. 6, 2023 by the European Patent Office for European Application No. 22201120.7.

* cited by examiner

*Primary Examiner* — Adriana Figueroa
(74) *Attorney, Agent, or Firm* — Boone IP Law

(57) ABSTRACT

A prefabricated cabin for being transported to an installation site comprises support legs below a cabin box configured for supporting the cabin box on top of them. The support legs are fixed to the cabin box and each comprise a first horizontal metal plate placed below the cabin box and supporting the cabin box on top of it, and a second horizontal metal plate configured for being placed against a supporting base. The second horizontal metal plate is at a distance below the first horizontal metal plate. One or more metal pillars are between the first and second horizontal metal plates, connecting them fixedly to each other.

12 Claims, 5 Drawing Sheets

A - A

PREFABRICATED CABIN, METHOD FOR BUILDING CABIN AND SUPPORT LEG OF CABIN

FIELD

The disclosure relates to a prefabricated cabin for being transported to an installation site, such as in particular a prefabricated log cabin. The disclosure also relates to a method for building a cabin as well as to a support a leg of a cabin. The cabin is suitable for accommodating people.

BACKGROUND

Such prefabricated cabins are known, where the cabin comprises a cabin box that can be transported as a unit, e.g., from a factory, to the installation site.

Conventionally, the prefabrication of a cabin has involved constructing a cabin box on top of an assembly base such as the factory floor. In case of a log cabin, constructing of the cabin box has involved piling of logs so that they form log walls of the cabin box surrounding an interior thereof. The piling has involved piling the logs on top of thin wood blocks giving support for the logs from below during the piling.

Transportation of a prefabricated cabin to the installation site can be carried out by placing the prefabricated cabin in a transport container for example. The prefabricated cabin is then lifted, moved and lowered to stand in its intended installation location on a foundation, which typically comprises foundation blocks provided beforehand in the installation location. The foundation blocks (e.g., lightweight aggregate concrete blocks) are typically at the area of corners of the cabin and used to raise the cabin a distance above ground so that a ventilation space is left below the cabin and between the foundation blocks. Permanent installation of the cabin requires careful isolation of the cabin box from damp rising from the ground via capillaries of the foundation.

A drawback of the aforementioned prior solutions has been that during assembling at the factory and later during transport of the cabin, it has been complicated to support and handle the cabin firmly while ensuring that the structure thereof is not harmed at any stage. In case of particularly a log cabin, a drawback has been that the supporting in different stages from initial steps of the assembling to the final installation has required different ways to ensure firm support of the cabin parts.

Another drawback of the aforementioned prior solutions has been that it has been challenging to ensure that the quality of the final supporting solution at the construction site is optimal in terms of rigidity, correctness of support points, damp proofing and ventilation.

BRIEF DESCRIPTION

An object of the disclosure is to introduce an improved support solution for a prefabricated cabin and a method for building a cabin. An object is particularly to introduce a solution by which one or more of the above-mentioned problems of prior art and/or drawbacks discussed or implied elsewhere in the description can be alleviated. An object is to introduce a solution, which provides a support from early steps of fabrication of the prefabricated cabin to final installation thereof. An object is to introduce a solution, which is well suitable for log cabins in particular.

It is introduced, inter alia, illustrative embodiments which give a robust and reliable support for elements of a cabin box during fabrication and/or transportation and/or final installation.

It is brought forward a new prefabricated cabin for being transported to an installation site, in particular a prefabricated log cabin, the prefabricated cabin comprising a cabin box comprising walls surrounding an interior of the cabin box; and support legs below corners of the cabin box configured for supporting the cabin box on top of them.

The support legs are fixed to the cabin box, each leg being in particular unattached to a supporting base, the prefabricated cabin being liftable and lowerable as one unit to stand on its support legs in a desired place, e.g., during transportation and/or installation, such as on a supporting base of a transport platform or of a transport container or of the installation site.

One or more of the legs, preferably each of said support legs, comprises

- a first horizontal metal plate placed below the cabin box and supporting the cabin box on top of it; and
- a second horizontal metal plate configured for being placed against a supporting base, the second horizontal metal plate being at a distance below the first horizontal metal plate; and
- one or more metal pillars between said first and second horizontal metal plates connecting them fixedly to each other.

With this kind of solution one or more of the above-mentioned objects can be facilitated.

Preferable further details of the prefabricated cabin are described in the following, which further details can be combined with the prefabricated cabin individually or in any combination.

In a preferred embodiment, each said wall comprises horizontal, i.e., horizontally oriented logs piled on top of each other.

In a preferred embodiment, each said leg is arranged to carry part of the weight of the cabin box.

In a preferred embodiment, each said support leg is below a corner of two adjacent walls of the cabin box.

In a preferred embodiment, the first horizontal metal plates of the leg are fixed to adjacent walls which are at an angle, preferably right angle, relative to each other.

In a preferred embodiment, the first horizontal metal plate of the leg is fixed to a log end of a first horizontal log of the cabin box and to a log end of a second horizontal log of the cabin box, which logs are at a right angle relative to each other.

In a preferred embodiment, a first log end of a first log rests on a first upper support face portion of the first horizontal metal plate and a second log end of a second log rests on a second upper support face portion of the first horizontal metal plate.

In a preferred embodiment, said first log and second horizontal log are at an angle, preferably at a right angle relative to each other.

In a preferred embodiment, said first and second horizontal logs are in particular logs of adjacent walls which are at right angle relative to each other.

In a preferred embodiment, the leg comprises a first lateral support and positioning member for a first log end to be fixed on the horizontal metal plate, and a second lateral support and positioning member for a second log end to be fixed on the horizontal metal plate, which lateral support members protrude upwards from the first horizontal metal plate.

In a preferred embodiment, the lateral support and positioning members are two vertical plates, which are at a right angle relative to each other.

In a preferred embodiment, the first lateral support and positioning member is fixed to the first log end and the second lateral support and positioning member is fixed to the second log end, in particular the lateral support and positioning members being in an inner corner formed between the first log end and second log end.

In a preferred embodiment, the cabin box comprises a floor and a roof.

In a preferred embodiment, the floor is preferably placed to rest on an upper support face portion of the first horizontal metal plate.

In a preferred embodiment, the cabin is a sauna cabin, preferably comprising a heater inside the interior.

In a preferred embodiment, the one or more metal pillars are welded to said first and second horizontal metal plates.

In a preferred embodiment, there are two of said metal pillars between said first and second horizontal metal plates connecting these fixedly to each other.

In a preferred embodiment, the two metal pillars are vertical, i.e., vertically oriented, metal plates.

In a preferred embodiment, the two metal pillars are spaced apart, an opening extending horizontally through the leg between the two metal pillars. This provides that a lifting or binding member, such as a cargo strap can be guided through the opening. This facilitates easy binding and/or lifting of the cabin during transport thereof. This also facilitates rigidity of the leg. Preferably, the opening is at least 10 cm wide in horizontal direction, and at least 5 cm high.

In a preferred embodiment, the first and second horizontal plates and the metal pillars define the borders of the opening.

In a preferred embodiment, the vertical projections of the two metal pillars are within the vertical projections of the adjacent walls, in particular such that the vertical projection of one of the two metal pillars is within the vertical projection of a first log end, and the vertical projection of the other within the vertical projection of a second log end.

In a preferred embodiment, the two metal pillars are vertical plates at an angle, preferably at a right angle relative to each other.

In a preferred embodiment, the vertical distance between the first and second horizontal plates is at least 5 cm, preferably 5-20 cm.

In the preferred embodiment, the floor rests on an upper support face portion of the first horizontal metal plate, which is horizontally displaced from the aforementioned upper support face portions of the first horizontal metal plate on which the first log end and the second log end rest.

In the preferred embodiment, the third upper support face portion is on the opposite side of the first and second lateral support and positioning members than the first and second support face portion.

In the preferred embodiment, the one or more metal pillars of a leg are for transmitting loads between the first and second horizontal metal plates. Preferably, there are no other structures than the one or more metal pillars connecting the first and second horizontal metal plates fixedly to each other.

In a preferred embodiment, when the cabin is placed to stand on a base supported by the legs, each leg is arranged to carry part of the weight of the cabin box, the vertical reaction forces from the base being transmitted via the second horizontal metal plate of a support leg to the one or more metal pillars of the support leg and via the one or more metal pillars to the first horizontal metal plate and via the first horizontal metal plate to the cabin box such as preferably to the log ends thereof.

In a preferred embodiment, the first horizontal metal plate of the leg comprises fixing holes for fixing the leg to the cabin box. In particular, the first horizontal metal plate of the leg comprises a first fixing hole through which a first fixing member extends vertically fixing the first log end against the first upper support face portion and a second fixing hole through which a second fixing member extends vertically fixing the second log end against the second upper support face portion. The first fixing hole extends through the first upper support face portion and the second fixing hole extends through the second upper support face portion.

In a preferred embodiment, the second horizontal metal plate of the leg comprises a fixing hole through which a fixing member, such as an anchor bolt, can be placed to extend for thereby fixing the leg to a base.

In a preferred embodiment, the vertical projection of the first metal plate overlaps at least partially with the vertical projection of two adjacent walls of the cabin box. Preferably, the support leg is completely on the inner side of the perimeter of the vertical projection of the walls of the cabin box. Thereby, it does not extend horizontally over the perimeter of said vertical projection of the walls of the cabin box. Thus, the leg is well hidden below the cabin box.

It is also brought forward a new support leg, in particular a support leg of a prefabricated cabin, the support leg comprising

- a first horizontal metal plate configured for supporting the cabin box on top of it;
  - a second horizontal metal plate configured for being placed against a supporting base, the second horizontal metal plate being at a distance below the first horizontal metal plate; and
  - one or more metal pillars between said first and second horizontal metal plates connecting them fixedly to each other.

With this kind of solution one or more of the above-mentioned objects can be facilitated.

Preferable further details of the support leg have been described already above and will be described moreover in the following, which further details can be combined with the method individually or in any combination.

In a preferred embodiment, the first horizontal metal plate comprises a first upper support face portion for a first log end to be placed to rest on the first horizontal metal plate, and a second upper support face portion for a second log end to be placed to rest on the first horizontal metal plate.

In a preferred embodiment, the first horizontal metal plate comprises a third upper support face portion for a floor to be placed to rest on the first horizontal metal plate.

In a preferred embodiment, the leg comprises a first lateral support and positioning member for a first log end to be fixed on the horizontal metal plate, and a second lateral support and positioning member for a second log end to be fixed on the horizontal metal plate, which lateral support members protrude upwards from the first horizontal metal plate.

In a preferred embodiment, the first lateral support and positioning member is beside the first upper support face portion for a first log end, and the second lateral support and positioning member is beside the second upper support face portion for a first log end.

In a preferred embodiment, the lateral support members are two vertical plates, which are at an angle preferably at a right angle relative to each other. Preferably, the lateral support members form a corner and the first and second upper support face portions are on an outer side of a corner formed by the first and second lateral support and positioning members. Thus, the log ends can be placed on the outer side of them.

In a preferred embodiment, the third upper support face portion of the first horizontal metal plate is horizontally displaced from the aforementioned upper support face portions of the first horizontal metal plate, preferably on the opposite side of the first and second lateral support and positioning members than the support face portions. Thus, a floor can be positioned in the inner corner of the cabin box to rest on the leg when this kind of structure is desired.

In a preferred embodiment, the one or more metal pillars are welded to said first and second horizontal metal plates.

In a preferred embodiment, there are two of said metal pillars between said first and second horizontal metal plates connecting these fixedly to each other.

In a preferred embodiment, the two metal pillars are vertical metal plates.

In a preferred embodiment, the two metal pillars are spaced apart, an opening extending horizontally through the leg between the two metal pillars.

In a preferred embodiment, the two metal pillars are at an angle, preferably at a right angle relative to each other.

In a preferred embodiment, the distance between the plates is at least 5 cm, preferably 5-20 cm.

In a preferred embodiment, for fixing the leg to the cabin box, the first horizontal metal plate of the leg comprises fixing holes. In particular, the first horizontal metal plate of the leg comprises a first fixing hole through which a first fixing member can be placed to extend vertically and a second fixing hole through which a second fixing member can be placed to extend vertically. The first fixing hole preferably extends through the first upper support face portion and the second fixing hole preferably extends through the second upper support face portion. The second horizontal plate moreover preferably, although not necessarily, comprises a fixing hole through which a fixing member, such as an anchor bolt, can be placed to extend for thereby fixing the leg to a base.

In a preferred embodiment, the first horizontal metal plate comprises a first edge and a second edge which are at right angle, the corner between the first and second edges being slanted such that a third edge extends between them at an angle relative to both of them, preferably at 45 deg.

In a preferred embodiment, the first and second metal plates and the one or more metal pillars are made of metal, preferably of steel. Preferably, the support leg is preferably made of metal, preferably of steel.

In a preferred embodiment, each said support leg comprising said first and second horizontal metal plates and said one or more metal pillars is below only one corner of the cabin box. Thus, the support legs below corners of the cabin box can be separate from each other.

It is also brought forward a new method of building a cabin, comprising

- providing a prefabricated cabin as defined anywhere above; and
- placing it to stand on its support legs on top of a supporting base (31) of a transport platform or of a transport container (30); and
- moving the transport platform or a transport container (30) to proximity of the installation site, such as preferably by truck; and
- placing the prefabricated cabin to stand on a supporting base of the installation site, such as on concrete blocks thereof.

With this kind of solution one or more of the above-mentioned objects can be facilitated.

Preferable further details of the method are described in the following which further details can be combined with the method individually or in any combination. Preferable further details of the prefabricated cabin and/or a support leg thereof have also been described earlier above which further details can be combined with the method individually or in any combination.

In a preferred embodiment, the providing a prefabricated cabin comprises

- providing logs
  - placing support legs on a base of a factory, such as a floor of a factory; and
  - placing logs on the support legs, such that they rest on first horizontal metal plates of the legs; and
  - fixing logs on the support legs; and
  - piling further logs on the logs fixed to the support legs.

In a preferred embodiment, said placing logs on the support legs is performed such that a first log end of a first log rests on a first upper support face portion of the first horizontal metal plate and a second log end of a second log rests on a second upper support face portion of the first horizontal metal plate.

In a preferred embodiment, said placing logs on the support legs is performed such that a first log end of a first log rests beside the first support and positioning member and a second log end of a second log rests beside the second support and positioning member.

In a preferred embodiment, in said fixing the first lateral support and positioning member is fixed to the first log end the second lateral support and positioning member is fixed to the second log end.

In a preferred embodiment, in said fixing the first log end is fixed to the first upper support face portion of the first horizontal metal plate, and the second log end is fixed to the second upper support face portion of the second horizontal metal plate, in particular by fixing members extending through the first metal plate.

In a preferred embodiment, the method comprises after said placing the prefabricated cabin to stand on a supporting base of the installation site leaving the legs unfixed to the supporting base, or alternatively fixing the supporting legs of the prefabricated cabin to a supporting base of the installation site such as to concrete blocks thereof. The first option is preferred and enabled by firmness of the leg structure, and moreover preferred in many cases, in particular if there is no particular need for anchoring the cabin to its base.

BRIEF DESCRIPTION OF THE DRAWINGS

In the following, the present disclosure will be described in more detail by way of example and with reference to the attached drawings, in which.

DETAILED DESCRIPTION

Figure 1:
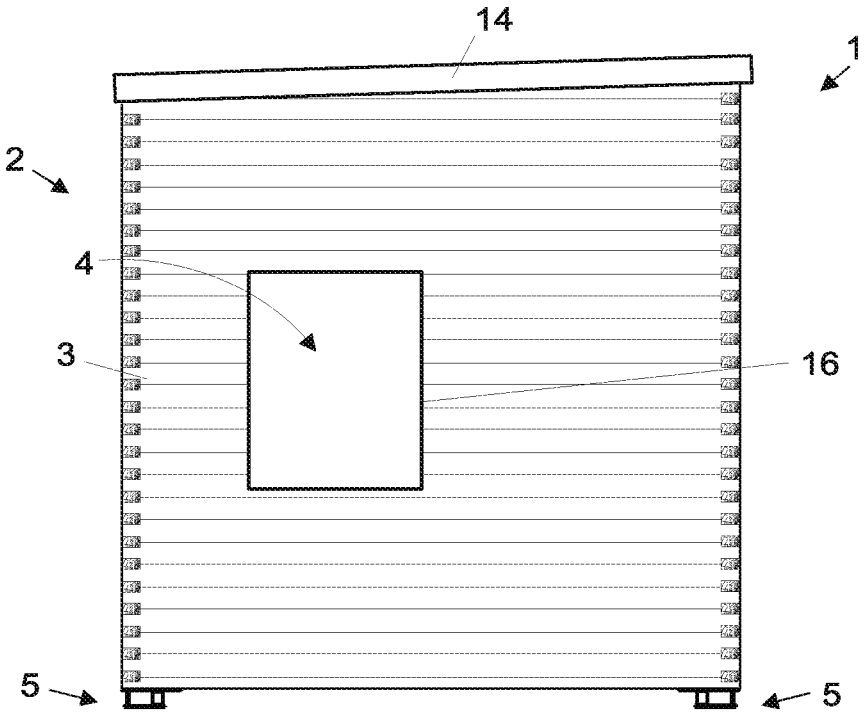
FIG. 1 illustrates an exemplary embodiment of a prefabricated cabin.

FIG. 1 illustrates an embodiment of a prefabricated cabin 1 for being transported to an installation site. The prefabricated cabin is a prefabricated log cabin. The prefabricated cabin 1 comprises a cabin box 2 comprising walls 3 surrounding an interior 4 of the cabin box 2; and support legs 5 below corners of the cabin box 2 configured for supporting the cabin box 2 on top of them. The support legs 5 are fixed to the cabin box 2. Each leg 5 is unattached to a supporting base. The prefabricated cabin 1 is liftable and lowerable as one unit to a desired place to stand on its support legs 5, e.g., during transportation and/or installation, such as on a supporting base of a transport platform or of a transport container or of the installation site.

FIGS. 2-8 illustrate the structure of a leg 5 and how it is preferably fixed to the cabin box 2.

Each said support leg 5 is arranged to carry part of the weight of the prefabricated cabin box 2. Each said support leg 5 comprises a first horizontal metal plate 6 placed below the cabin box 2 and supporting the cabin box 2 on top of it; and a second horizontal metal plate 7 configured for being placed against a supporting base, the second horizontal metal plate 7 being at a distance below the first horizontal metal plate 6; and one or more metal pillars 8,9 between said first and second horizontal metal plates 6,7 connecting them fixedly to each other. The one or more metal pillars 8,9 of the leg 5 are arranged to maintain the plates 6,7 at said distance from each other and to transmit loads between them.

In the preferred embodiment illustrated, each said wall 3 comprises horizontal, i.e., horizontally oriented, logs 10 piled on top of each other.

In a preferred embodiment, the vertical projection of the first metal plate 6 overlaps at least partially with the vertical projection of two adjacent walls 3 of the cabin box 2. This facilitates that loads are transmitted vertically without unnecessary torque. Preferably, the support leg 5 is completely on the inner side of the perimeter of the vertical projection of the walls 3 of the cabin box 2. Thereby, it does not extend horizontally over the perimeter of said vertical projection of the walls 3 of the cabin box 2. Thus, the leg is well hidden below the cabin box 2. This is visible in FIGS. 7 and 8.

The aforementioned support legs 5 are fixed to the cabin box below a corner of two adjacent walls of the cabin box 2, and also referred to as corner legs. Additional support legs could be provided also elsewhere than corners only, particularly in cases where the prefabricated cabin is relatively large or heavily loaded.

Figure 2:
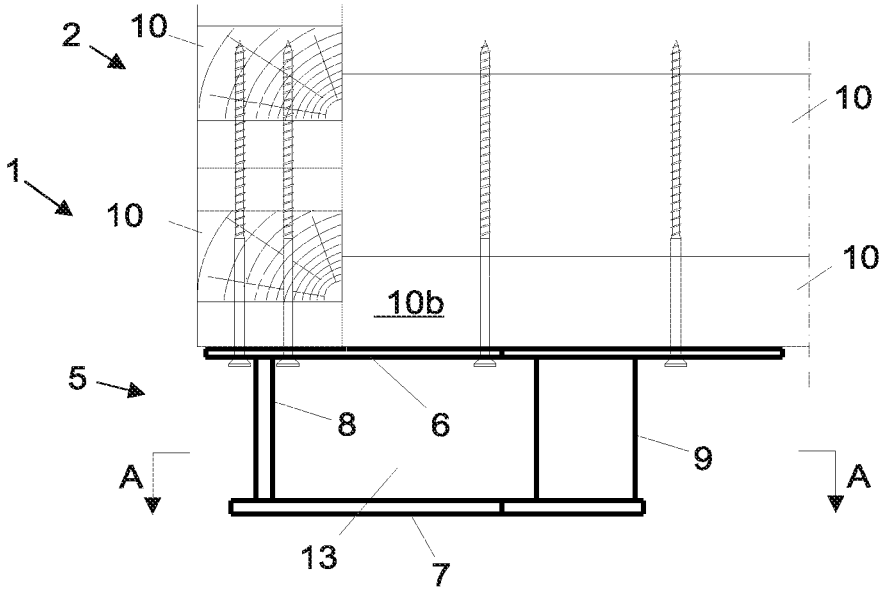
FIG. 2 illustrates enlarged a front view of the left lower corner of the prefabricated cabin of FIG. 1 and the structure and fixing of a support leg according to an exemplary embodiment.
Figure 3:
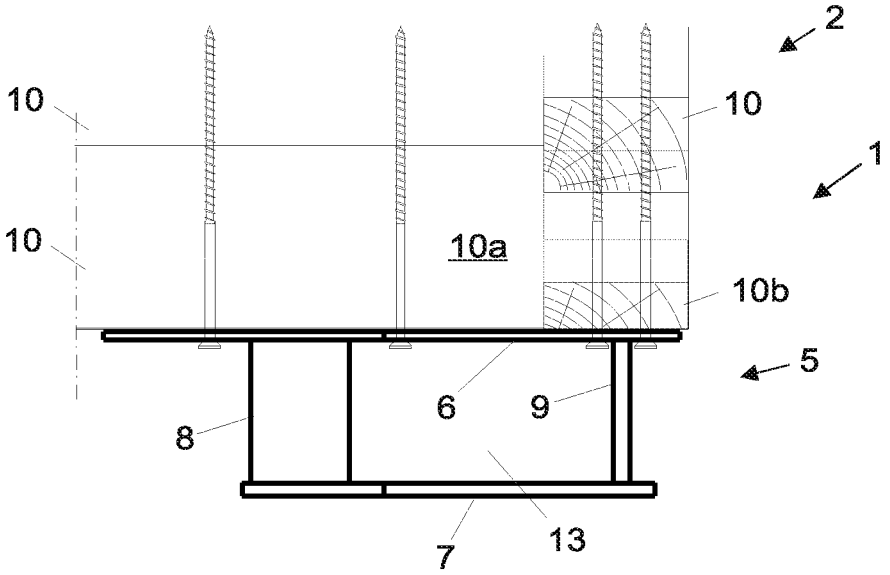
FIG. 3 illustrates the corner of FIG. 2 as viewed from the left side.

In the preferred embodiments, the first horizontal metal plate 6 is fixed to two adjacent walls of the cabin box 2, which adjacent walls are at an angle, in particular right angle relative to each other. The first horizontal metal plate 6 of the corner leg 5 is fixed to a first log end 10*a* of a first horizontal log 10 of the cabin box 2 and to a second log end 10*b* of a second horizontal log 10 of the cabin box 2, which logs are at a right angle relative to each other. Said first and second horizontal logs are logs 10 of adjacent walls which are at right angle relative to each other. The logs 10 and log ends 10*a*,10*b* are illustrated in FIGS. 1-3, and their projections are visible in FIGS. 7 and 8 in broken line as viewed from above. The first log end 10*a* of the first horizontal log 10 rests on a first upper support face portion 6*a* of the first horizontal metal plate 6 and the second log end 10*b* of the second horizontal log 10 rests on a second upper support face portion 6*b* of the first horizontal metal plate 6. Said upper support face portions 6*a*,6*b* are horizontal and coplanar.

In the preferred embodiment, there are two, and preferably only two as illustrated, of said metal pillars 8,9 between said first and second horizontal metal plates 6,7 connecting these fixedly to each other. The two pillars 8,9 are vertical (i.e., vertically oriented) metal plates. The thickness of the plates 8,9 is preferably 4-20 mm, most preferably 8-15 mm. The length of the plates in horizontal direction is preferably 4-20 cm.

The two metal pillars 8,9 are spaced apart, an opening extending horizontally through the leg 5 between the two metal pillars 8,9. This provides that a lifting or binding member, such as a cargo strap can be guided through the opening. This facilitates easy binding and/or lifting of the prefabricated cabin during transport thereof. This also facilitates rigidity of the leg. Preferably, the opening is at least 10 cm wide in horizontal direction, and at least 5 cm high (preferably equal to the distance between the plates 6,7) since hereby said advantages are considerable.

The two metal pillars 8,9 being metal plates 8,9 and spaced apart facilitates that the structure 6,7,8,9 as seen from side becomes cellular and extremely high rigidity can be achieved for the leg 5 with relatively small amount of metal material. The structure is in the preferred embodiment overall such that the metal plates 6,7,8,9 define the borders of the opening 13.

Preferably, the distance between the plates 6,7 is at least 5 cm, preferably 5-20 cm. These ranges facilitate considerably the aim to raise the prefabricated cabin a distance above ground so that a ventilation space is left below the prefabricated cabin without making the leg 5 unstable.

Said metal plates 8,9 are preferably at an angle relative to each other, preferably at 70-110 deg, most preferably at a right angle relative to each other. The angle provides that a relatively long (in horizontal direction) pillar plate 8,9 can be used and it can be simply positioned below the walls of the parallel to the walls.

The one or more metal pillars 8,9 are preferably welded to said first and second horizontal metal plates.

Figure 7:
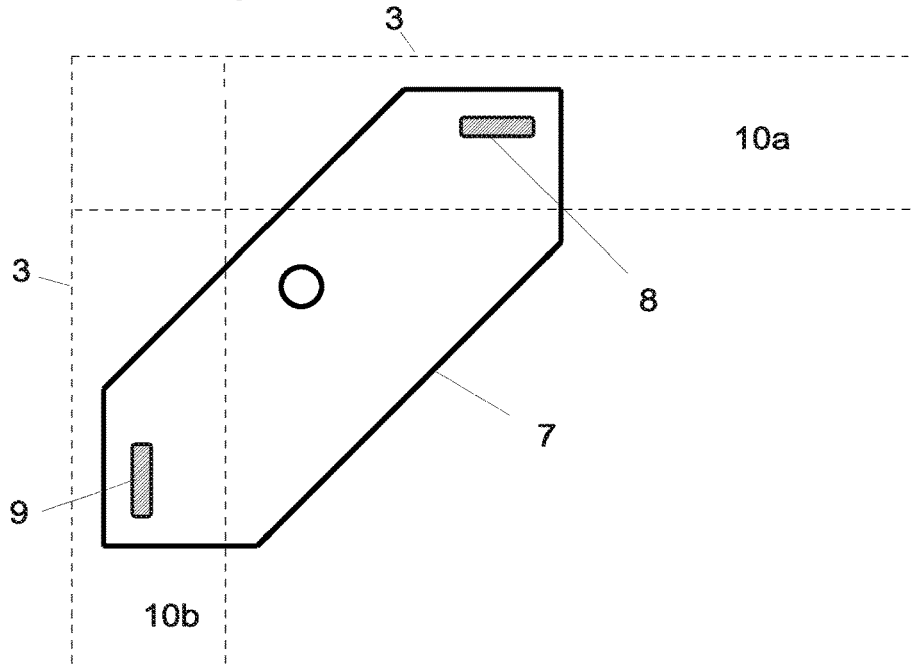
FIG. 7 illustrates the cross section A-A of FIG. 2.
Figure 8:
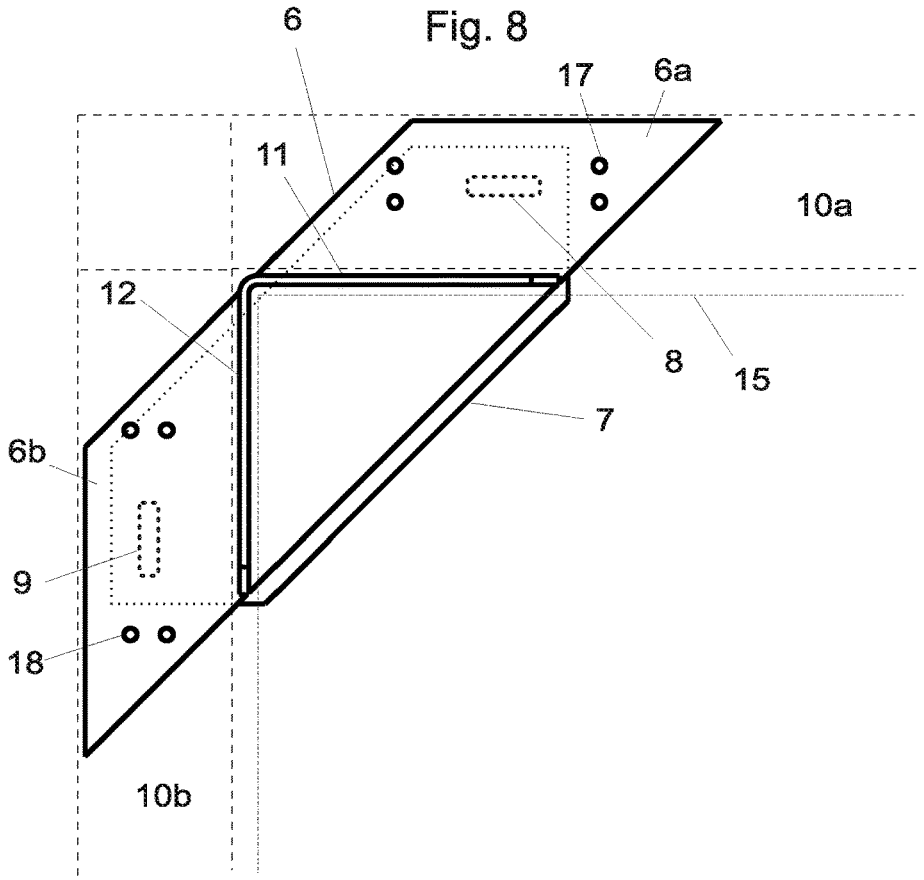
FIG. 8 illustrates the top view of the cross section support leg of FIG. 2, showing structures of the cabin box in broken line.

The vertical projections of the two metal pillars 8,9 are within the vertical projections of the adjacent walls, as illustrated in FIGS. 7-8. Thus, in general no unnecessary torque is formed. In particular, the vertical projection of one of the two metal pillars 8,9 is within the vertical projection of the first log end, and the vertical projection of the other within the vertical projection of the second log end.

Figure 4:
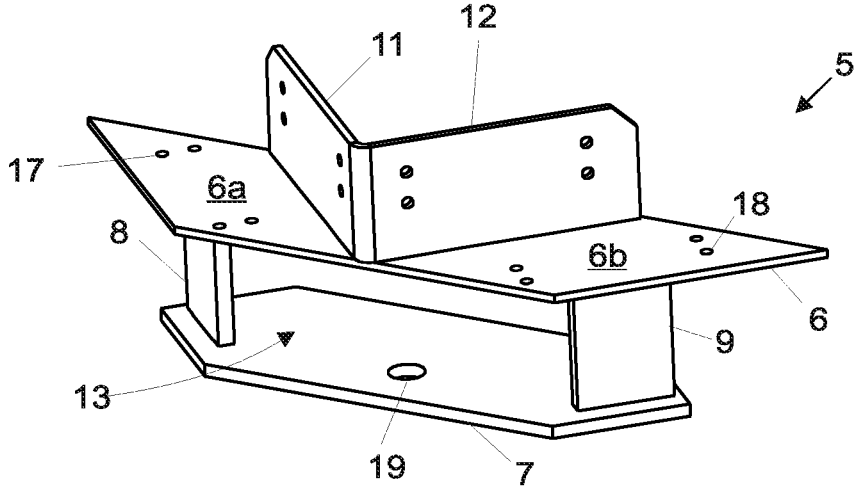
FIGS. 4-6 illustrate each a perspective view of a support leg of FIGS. 1-3.
Figure 5:
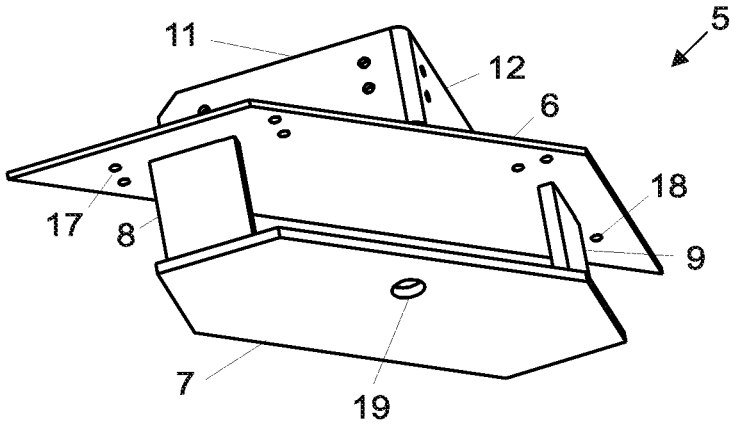
Figure 6:
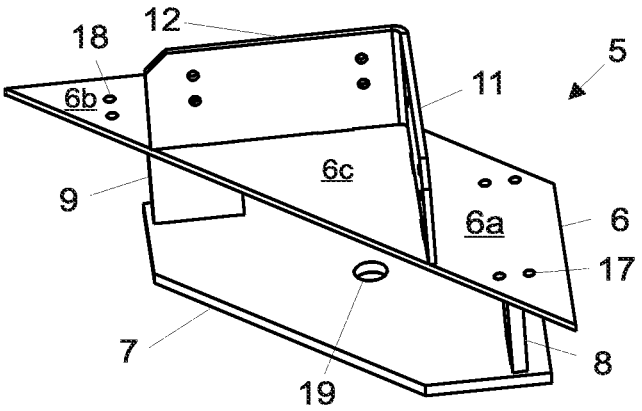

As visible in FIGS. 3 and 4, the corner leg 5 comprises a first lateral support and positioning member 11 for a structure of the cabin box 2, in particular for a first log end 10*a*, to be fixed on the horizontal metal plate 6, and a second lateral support and positioning member 12 for a structure of the cabin box 2, in particular for a second log end 10*b* to be fixed on the horizontal metal plate 6, which lateral support members 11,12 protrude upwards from the first horizontal metal plate 6. Owing to said lateral support and positioning members, the leg 5 can provide not only firm vertical support for the cabin box but also the ability to give firm lateral support and to ensure accurate positioning.

In the preferred embodiment, the first lateral support and positioning member 11 is beside the first upper support face portion 6*a* for a first log end 10*a* and the second lateral support and positioning member 12 is beside the second upper support face portion 6*b* for a second log end 10*b*. In the prefabricated cabin 1, the first log end 10*a* of a first log 10 rests beside the first support and positioning member 11, in particular on the first upper support face portion 6*a* and a second log end 10*b* of a second log 10 rests beside the second support and positioning member 12 in particular on the second upper support face portion 6*b*.

The lateral support members are two vertical metal plates, which are at an angle relative to each other, most preferably at an angle 70-110 deg relative to each other, most preferably at a right angle relative to each other. The angle preferably is the same as the angle between the adjacent walls below the corner of which the leg 5 is positioned and/or the same as the angle between the first log end 10*a* and the second log end 10*b*.

The lateral support and positioning members 11,12 are placed against and fixed to the first log end 10*a* and second log end 10*b*, in particular in an inner corner formed between the first log end 10*a* and second log end 10*b*. This is illustrated in FIG. 8. The lateral support and positioning members 11,12 being in the inner corner provides that they are invisible outside the cabin box 2 making it possible to leave the outer corner of the cabin box 2 free of such members.

The cabin box 2 preferably also comprises a roof 14 as visible in FIG. 1. The cabin box 2 preferably also comprises a floor 15. The floor 15 is illustrated by broken line 15 in FIG. 8. The floor 15 is preferably placed to rest on a third upper support face portion 6*c* of the first horizontal metal plate 6 (shown in FIG. 6). Thus, the leg 5 can provide also a support face portion on top of which the floor 15 can rest. This is however not necessary, because the floor 15 could alternatively be provided or arranged in some other way, such as a floor could be mounted on the walls 3 of the cabin box 2, for instance.

The cabin box 2 preferably comprises one or more openings 16, such as window openings and/or door openings. The cabin box 2 preferably comprises a window mounted in a window opening and/or a door mounted in a door opening.

The prefabricated cabin 1 is preferably a prefabricated sauna cabin, preferably comprising in the interior 4 a heater and/or sauna benches. The heater could also be installed later in the interior 4, for example after transport and installation of the prefabricated cabin 1. The prefabricated cabin 1 could alternatively be some other kind of prefabricated cabin 1. It could be for instance a prefabricated storage cabin or a small prefabricated cottage cabin.

The leg 5 comprises a third upper support face portion 6*c* of the first horizontal metal plate 6, which is horizontally displaced from the aforementioned upper support face portions 6*a*,6*b* of the first horizontal metal plate 6 on which the first log end 10*a* and the second log end 10*b* rest. In particular, in the preferred embodiment visible in FIGS. 4-6, the upper support face portion 6*c* is on the opposite side of the first and second lateral support and positioning members 11,12 than the support face portions 6*a*,6*b*. Thus, a floor 15 can be positioned in the inner corner of the cabin box to rest on the leg 5 when this kind of structure is desired.

Figure 10:
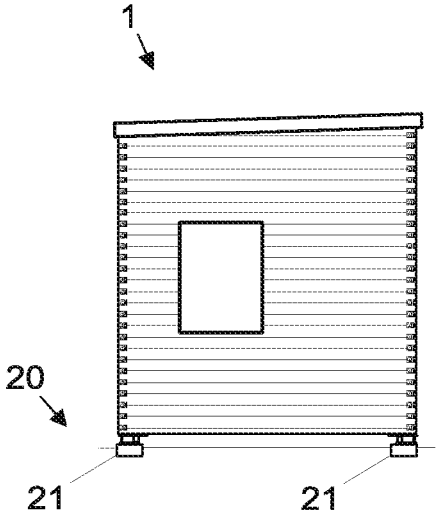
FIG. 10 illustrates a phase in the method according to an exemplary embodiment, wherein the prefabricated cabin is placed to stand on a supporting base of the installation site.
Figure 11:
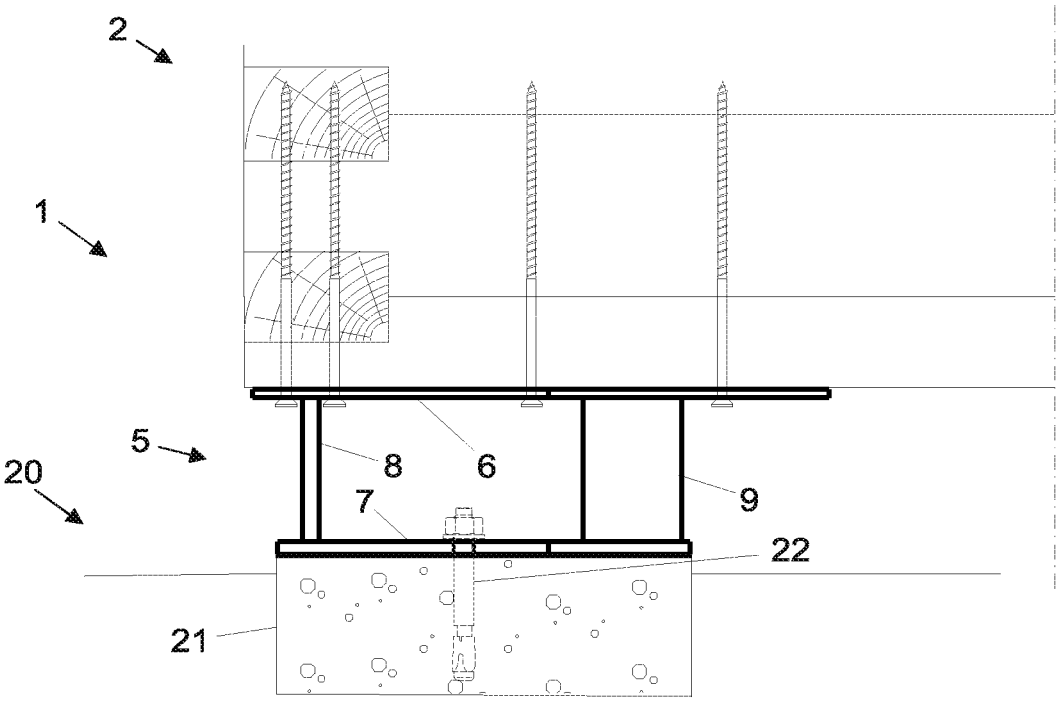
FIG. 11 illustrates enlarged a front view of the left lower corner of the prefabricated cabin of FIG. 10.

The prefabricated cabin 1 can be placed to stand on a base, such as a base illustrated in FIGS. 10 and 11, supported by the legs 5. Each leg 5 is arranged to carry part of the weight of the cabin box 2, the vertical reaction forces from the base 20 being transmitted via the second horizontal metal plate 7 of a support leg 5 to the one or more metal pillars 8,9 of the support leg 5 and via the one or more metal pillars 8,9 to the first horizontal metal plate 6 and via the first horizontal metal plate 6 to the cabin box 2 such as preferably to the log ends thereof.

For fixing the prefabricated cabin 1 to the cabin box 2, the first horizontal metal plate 6 of the leg 5 comprises fixing holes 17,18 (shown in FIG. 8). In particular, the first horizontal metal plate 6 of the leg 5 comprises a first fixing hole 17 through which a first fixing member extends vertically fixing the first log end 10*a* against the first upper support face portion 6*a* and a second fixing hole 18 through which a second fixing member extends vertically fixing the second log end against a second upper support face portion 6*b*. The first fixing hole 17 extends through the first upper support face portion 6*a* and the second fixing hole 18 extends through the second upper support face portion 6*b*.

For fixing the prefabricated cabin 1 to stand immovably on a base, such as a base 20 illustrated in FIGS. 10 and 11, the second horizontal metal plate 7 of the leg 5 comprises a fixing hole 19 (shown in FIG. 4) through which a fixing member, such as an anchor bolt, can be placed to extend for thereby fixing the leg 5 to a base 20.

The support leg 5 of a prefabricated cabin 1, as such, according to an embodiment, comprises a first horizontal metal plate 6 configured for supporting the cabin box 2 on top of it and a second horizontal metal plate 7 configured for being placed against a supporting base, the second horizontal metal plate 7 being at a distance below the first horizontal metal plate 6; and one or more metal pillars 8,9 between said first and second horizontal metal plates 6,7 connecting them fixedly to each other. Several preferred details of the support leg 5 have already been described above, where the support leg has been described together with the cabin box 2. In the following the structure of the support leg 5, as such, is further described.

The first horizontal metal plate 6 comprises a first upper support face portion 6*a* for a first log end 10*a* to be placed to rest on the first horizontal metal plate 6 and a second upper support face portion 6*b* for a second log end 10*a* to be placed to rest on the first horizontal metal plate 6.

The first horizontal metal plate 6 comprises a third upper support face portion 6*c* for a floor 15 to be placed to rest on the first horizontal metal plate 6. As mentioned, this is not necessary since the floor could be also otherwise mounted or provided.

In the preferred embodiment, the leg 5 comprises a first lateral support and positioning member 11 for a first log end 10*a* to be fixed on the horizontal metal plate 6, and a second lateral support and positioning member 12 for a second log end 10*b* to be fixed on the horizontal metal plate 6, which lateral support members 11,12 protrude upwards from the first horizontal metal plate 6. The lateral support and positioning members are not necessary, but advantageous for achieving a leg structure that is overall extremely efficient in terms of rigidity and functions provided. The lateral support and positioning members can be integral to each other and connected at their ends to each other as illustrated, but this is not necessary.

In the preferred embodiment, the first lateral support and positioning member 11 is beside the first upper support face portion 6*a* for a first log end 10*a* and the second lateral support and positioning member 12 is beside the second upper support face portion 6*b* for a first log end 10*b*.

In the preferred embodiment, the lateral support members 11,12 are two vertical plates, which are at an angle, preferably at a right angle relative to each other as illustrated. The lateral support members 11,12 form a corner and the first and second upper support face portions 6*a*,6*b* are on an outer side of a corner formed by the first and second lateral support and positioning members 11,12. Thus, the log ends 10*a*,10*b* can be placed on the outer side of them and said members 11,12 need not be visible to the outside.

The third upper support face portion 6*c* of the first horizontal metal plate 6 is horizontally displaced from the aforementioned upper support face portions 6*a*,6*b* of the first horizontal metal plate 6, preferably on the opposite side of the first and second lateral support and positioning members 11,12 than the first and second support face portion 6*a*,6*b*. Thus, a floor 15 can be positioned in the inner corner of adjacent walls of the cabin box 2 to rest on the leg 5 when this kind of structure is desired.

As mentioned, the one or more metal pillars are preferably welded to said first and second horizontal metal plates. Preferably, there are two of said metal pillars 8,9 between said first and second horizontal metal plates 6,7 connecting these fixedly to each other. The two support leg members 8,9 are preferably vertical metal plates, as illustrated. Preferably, the two metal pillars 8,9 are spaced apart, an opening extending horizontally through the leg 5 between the two metal pillars 8,9. The two metal plates 8,9 are preferably at an angle, preferably at a right angle relative to each other. The distance between the plates 6,7 is preferably at least 5 cm, preferably 5-20 cm.

For fixing the leg 5 to the cabin box 2, the first horizontal metal plate 6 of the leg 5 comprises fixing holes 17,18. In particular, the first horizontal metal plate 6 of the leg 5 comprises a first fixing hole 17 through which a first fixing member can be placed to extend vertically and a second fixing hole 18 through which a second fixing member can be placed to extend vertically. The first fixing hole 17 extends through the first upper support face portion 6*a* and the second fixing hole 18 extends through the second upper support face portion 6*b*. The leg 5 comprises a fixing hole 19 through which a fixing member, such as an anchor bolt, can be placed to extend for thereby fixing the leg 5 to a supporting base 20, of the installation site, such as to concrete blocks 21 thereof.

As for the shape of the first horizontal metal plate 6, preferably it comprises a first edge and a second edge which are at right angle, and the corner between the first and second edges is preferably slanted, such that a third edge extends between them at an angle relative to both of them, preferably 45 deg.

Figure 9:
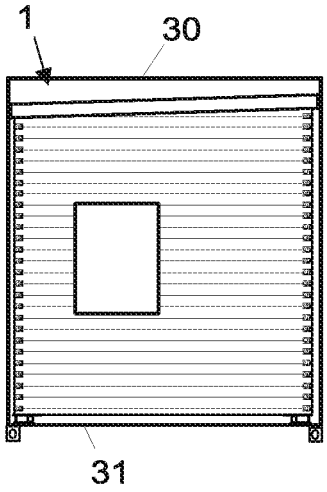
FIG. 9 illustrates a phase in the method according to an exemplary embodiment, wherein the prefabricated cabin is on top of a supporting base of a transport container.

In an embodiment of a method of building a cabin, the method comprises providing a prefabricated cabin 1 as described anywhere above and illustrated in FIGS. 1,2,3, 7 and 8; and thereafter moving the prefabricated cabin 1 to be on a supporting base of a transport platform or of a transport container 30, said moving comprising placing it to stand on its support legs 5 on top of the supporting base of a transport platform or of a transport container 30, as illustrated in FIG. 9. After this, the method comprises moving said transport platform or a transport container 30 to proximity of the installation site, such as by truck. After this, the method comprises placing the prefabricated cabin 1 to stand on a supporting base 20 of the installation site, such on concrete blocks 21 thereof, as illustrated in FIG. 10. The concrete blocks 21 can be concrete plates for example. Concrete blocks are easy and quick to install, and in most case sufficient form of a supporting base for the prefabricated cabin 1 as presented. The supporting base 20 could alternatively be of some other kind, such as asphalt or dense sand foundation, for example.

After said placing the prefabricated cabin 1 to stand on a supporting base 20 of the installation site, the method preferably comprises leaving the support legs 5 unfixed to the supporting base 20. This is enabled by firmness of the leg structure, and moreover preferred in many cases, in particular if there is no particular need for anchoring the cabin 1 to its base. Leaving the support legs 5 unfixed is advantageous since in the structure of the prefabricated cabin 1 presented, the legs 5 are below the cabin box 2 supporting the cabin box 2 on top of it. Performing fixing, such as component positioning and accurate drillings, after the prefabricated cabin 1 stands on the supporting base 20 would consume additional time, e.g., due to the limited space.

Alternatively, the method can comprise after said placing the prefabricated cabin 1 to stand on a supporting base 20 of the installation site fixing the legs of the prefabricated cabin 1 to a supporting base 20 of the installation site, such as to concrete blocks 21 thereof. The fixing can be performed for example by anchor bolts 22 extending through fixing holes 19 of the legs 5. However, as mentioned this fixing is not necessary. Due to optionality of the fixing, the anchor bolt 22 is illustrated in broken line in FIG. 11.

The aforementioned step of providing a prefabricated cabin 1 preferably comprises providing logs 10; and placing support legs 5 on a base of a factory, such as a floor of a factory; and placing logs on the support legs 5, such that they rest on first horizontal metal plates 6 of the support legs 5; and fixing logs 10 on the support legs 5; and piling further logs on the logs fixed to the support legs 5.

Preferably, said placing logs 10 on the support legs 5 is performed such that a first log end 10*a* of a first log 10 rests on a first upper support face portion 6*a* of the first horizontal metal plate 6 and a second log end 10*b* of a second log 10 rests on a second upper support face portion 6*b* of the first horizontal metal plate 6. Thus, the log ends 10*a*,10*b* are as illustrated in FIGS. 1-3.

Said placing logs 10 on the support legs 5 is performed particularly preferably such that a first log end 10*a* of a first log 10 rests beside the first support and positioning member 11 and a second log end 10*b* of a second log 10 rests beside the second support and positioning member 12.

Preferably, in said fixing the first lateral support and positioning member 11 is fixed to the first log end 10*a* and the second lateral support and positioning member 12 is fixed to the second log end 10*a*.

Preferably, in said fixing the first log end 10*a* is fixed to the first upper support face portion 6*a* of the first horizontal metal plate 6, and the second log end 10*b* is fixed to the second upper support face portion 6*b* of the second horizontal metal plate 6, in particular by fixing members extending through the first metal plate 6. This fixing could be alternatively or additionally be implemented by fixing members extending through the members 11,12.

Generally, in said fixing logs 10 on the support legs 5, preferably one or more layers of horizontally oriented logs 10 can be fixed. More than one layers can be fixed, e.g., by long vertical screws for example as illustrated in FIGS. 2 and 3, but this is not necessary, since some other kind of fixing could alternatively be used.

The method may comprise at some point when desired, a step of binding the prefabricated cabin 1 immovably to its place, by a binding member such as a cargo strap, guided through an opening 13 extending horizontally through a leg 5 of the prefabricated cabin 1 between two metal pillars 8,9 of the leg 5. Thus, the leg structure can facilitate securing of the prefabricated to be immovable, e.g., during its transportation from the factory to the installation site. The method can particularly comprise the step of binding for instance between said placing the prefabricated cabin 1 to stand on its support legs 5 on top of a supporting base 31 of a transport platform or of a transport container 30 and said moving the transport platform or the transport container 30.

Generally preferably (although not necessarily), the prefabricated cabin is in particular a prefabricated log cabin, since in this context the leg structure is highly advantageous, for example due to facilitating fabrication of the prefabricated cabin at a factory, such as placing and piling of logs thereon, as well as due to facilitating supporting on support bases and movability of the cabin parts in different stages from initial steps of the fabrication to the final installation.

It is to be understood that the above description and the accompanying Figures are only intended to teach the best way known to the inventors to make and use the subject matter of the disclosure. It will be apparent to a person skilled in the art that the inventive concept can be implemented in various ways. The above-described embodiments of the disclosure may thus be modified or varied, without departing from the disclosure, as appreciated by those skilled in the art in light of the above teachings. It is therefore to be understood that the disclosure and its embodiments are not limited to the examples described above but may vary within the scope of the claims.

The invention claimed is:

1. A prefabricated cabin for being transported to an installation site, the prefabricated cabin comprising:

a cabin box comprising walls surrounding an interior of the cabin box; and support legs below corners of the cabin box configured for supporting the cabin box on top of the support legs, wherein the support legs are fixed to the cabin box, the cabin box being liftable and lowerable as one unit to stand on the support legs in a desired place;

wherein one or more of said support legs comprises:

a first horizontal metal plate placed below the cabin box and supporting the cabin box on top of the first horizontal metal plate; and a second horizontal metal plate configured for being placed against a supporting base, the second horizontal metal plate being at a distance below the first horizontal metal plate; and one or more metal pillars between said first and second horizontal metal plates and connecting said first and second horizontal metal plates fixedly to each other, wherein the one or more metal pillars include two metal pillars between said first and second horizontal metal plates connecting the first and second horizontal metal plates fixedly to each other, and wherein the two metal pillars are spaced apart, an opening extending horizontally through each support leg of the support legs between the two metal pillars.

2. The prefabricated cabin according to claim 1, wherein the first horizontal metal plate of the one or more of said support legs is fixed to a first log end of a first horizontal log of the cabin box and to a second log end of a second horizontal log of the cabin box, wherein the first and second horizontal logs are at an angle relative to each other.

3. The prefabricated cabin according to claim 1, wherein a first log end of a first horizontal log rests on a first upper support face portion of the first horizontal metal plate and a second log end of a second horizontal log rests on a second upper support face portion of the first horizontal metal plate.

4. The prefabricated cabin according to claim 1, wherein the one or more of said support legs comprises a first lateral support and positioning member for a first log end to be fixed on the first horizontal metal plate, and a second lateral support and positioning member for a second log end to be fixed on the first horizontal metal plate, wherein the first and second lateral support and positioning members protrude upwards from the first horizontal metal plate.

5. The prefabricated cabin according to claim 4, wherein the first lateral support and positioning member is fixed to the first log end and the second lateral support and positioning member is fixed to the second log end, the first and second lateral support and positioning members being in an inner corner formed between the first log end and the second log end.

6. The prefabricated cabin according to claim 1, wherein the two metal pillars are vertical metal plates.

7. The prefabricated cabin according to claim 1, wherein the two metal pillars are vertical metal plates at an angle relative to each other.

8. The prefabricated cabin according to claim 1, wherein vertical projections of the two metal pillars are within vertical projections of the adjacent walls, such that the vertical projection of one of the two metal pillars is within the vertical projection of a first log end, and the vertical projection of the other of the two metal pillars is within the vertical projection of a second log end.

9. The prefabricated cabin according to claim 1, wherein each of the one or more of said support legs is below only one respective corner of the cabin box.

10. A method of building a cabin, comprising:

providing a prefabricated cabin according to claim 1; and placing the prefabricated cabin to stand on the support legs on top of a supporting base of a transport platform or of a transport container; and moving the transport platform or the transport container to proximity of an installation site; and placing the prefabricated cabin to stand on a supporting base of the installation site.

11. The method according to claim 10, wherein the providing a prefabricated cabin comprises:

providing logs;

placing support legs on a base of a factory; and placing the logs on the support legs, such that they rest on the first horizontal metal plates of the legs; and fixing the logs on the support legs; and piling further logs on the logs fixed to the support legs.

12. The method according to claim 11, wherein said placing logs on the support legs is performed such that:

a first log end of a first log rests on a first upper support face portion of the first horizontal metal plate and a second log end of a second log rests on a second upper support face portion of the first horizontal metal plate; and/or the first log end of the first log rests beside a first support and positioning member and a second log end of a second log rests beside a second support and positioning member of the support leg.

* * * * *